US006112933A

United States Patent [19]

Meyer et al.

[11] Patent Number: 6,112,933

[45] **Date of Patent: *Sep. 5, 2000**

[54] TAMPER-RESISTANT CAP FOR A CONTAINER

[75] Inventors: Erin M. Meyer; David J. Jochem, both of Evansville, Ind.

[73] Assignee: Berry Plastics Corporation, Evansville, Ind.

[ * ] Notice: This patent is subject to a terminal disclaimer.

[21] Appl. No.: 09/103,599

[22] Filed: Jun. 24, 1998

Related U.S. Application Data

[63] Continuation-in-part of application No. 08/625,758, Mar. 29, 1996, Pat. No. 5,788,107.

[51] Int. Cl.[7] ..... B65D 25/00; B65D 25/38

[52] U.S. Cl. ..... 220/284; 215/302; 220/724; 220/915

[58] Field of Search ..... 220/284, 724, 220/915, 281, 285, 286; 215/302, 304

[56] References Cited

U.S. PATENT DOCUMENTS

| | | |
|---|---|---|
| 2,707,968 | 5/1955 | Efford . |
| 2,765,960 | 10/1956 | Soffer et al. . |
| 3,022,922 | 2/1962 | Patton et al. . |
| 3,146,916 | 9/1964 | Kronheim . |
| 3,322,298 | 5/1967 | Gach . |
| 3,334,769 | 8/1967 | Gach . |
| 3,358,875 | 12/1967 | Ekstrom . |
| 3,414,167 | 12/1968 | Osrow . |
| 3,460,708 | 8/1969 | Vollers . |
| 3,514,011 | 5/1970 | Madeira et al. . |
| 3,515,307 | 6/1970 | Gach . |
| 3,532,249 | 10/1970 | Gach . |
| 3,690,519 | 9/1972 | Wassilieff . |
| 3,870,187 | 3/1975 | Bennett . |
| 3,955,716 | 5/1976 | Goncalves . |
| 3,964,634 | 6/1976 | Jasinski et al. . |
| 4,130,220 | 12/1978 | McKirnan . |
| 4,230,230 | 10/1980 | Mumford . |
| 4,506,808 | 3/1985 | Goncalves . |
| 4,775,062 | 10/1988 | Carle et al. . |
| 5,337,912 | 8/1994 | Jochem . |

FOREIGN PATENT DOCUMENTS

| | | |
|---|---|---|
| 2044735 | 10/1990 | United Kingdom . |

*Primary Examiner*—Stephen Castellano
*Assistant Examiner*—Niki M. Eloshway
*Attorney, Agent, or Firm*—Barnes & Thornburg

[57] ABSTRACT

A cap is provided for mounting on a necked-in can. The cap includes a shell formed to include an interior region and a tool-receiving aperture opening into the interior region. A ridge is appended to the shell and positioned to lie in the interior region of the cap. The ridge includes a downwardly facing ridge edge that lies inside the interior region of the cap and adjacent to the tool-receiving aperture. The ridge edge overlies a portion of an annular lip of the necked-in can when the cap is mounted on the can so that a cap-removal tool can be inserted into the interior region of the shell through the tool-receiving aperture simultaneously to engage the annular lip of the can and the ridge edge. When the cap-removal tool is rotated manually about its longitudinal axis, the cap-removal tool acts between the ridge edge and the annular lip to demount the cap from the necked-in can.

39 Claims, 3 Drawing Sheets

TAMPER-RESISTANT CAP FOR A CONTAINER

This is a continuation in part application of application Ser. No. 08/625,758, filed Mar. 29, 1996.

BACKGROUND AND SUMMARY OF THE INVENTION

This invention relates to caps for mounting on the top of aerosol cans or the like, and particularly to a tamper-resistant cap that is disengageable from an annular lip formed on the can using a cap-removal tool such as a flat blade screwdriver. More particularly, this invention relates to a tamper-resistant cap having a rigidified lift pad that is located to lie in spaced-apart relation to the annular lip on the can when the cap is mounted on the can and engage the cap-removal tool during removal of the cap from the can.

Everyone has seen an aerosol can provided with a plastic cap mounted on top of the can to cover the aerosol spray button. To release the pressurized contents of the can, it is customary to remove the cap, hold the can upright, aim the discharge opening in the right direction, and depress the aerosol spray button. Such caps are typically formed in a mold using a plastics material such as polypropylene or high-density polyethylene. The caps are usually molded to include a shell and various internal ribs and flanges. Of course, these molded caps can also be used to cover the discharge openings provided in containers other than aerosol cans.

A "necked-in" can is one type of aerosol can that is usually made of steel and includes a cylindrical body, a dome-shaped closure member coupled to the top of the cylindrical body to form an annular lip around the top edge of the cylindrical body, and a spray button mounted in the dome-shaped closure member and configured to control discharge of pressurized material in the can. One example of a conventional necked-in can is shown in U.S. Pat. No. 5,337,912 to Jochem.

It is known to make plastic caps for mounting on cans to cover the spray button mounted in the dome-shaped closure member. See, for example, U.S. Pat. No. 5,337,912 to Jochem (necked-in can) and U.S. Pat. No. 3,460,708 to Vollers (straight-wall can). It is also known to form a plastic cap for a straight-wall can to include a lower edge for engaging a tool such as a flat blade screwdriver that can be used to remove the cap from its initial tamperproof position on the straight-wall can. See, for example, U.S. Pat. No. 3,414,167 to Osrow and U.S. Pat. No. 3,334,769 to Gach.

What is needed is a tamper-resistant cap for a necked-in can that has a tool-engaging lift pad that is located and configured to disallow a person from using a cap-removal tool improperly in a way that might inadvertently puncture the dome-shaped closure member in the necked-in can during removal of the cap from the necked-in can. Consumers would also appreciate a cap having a reinforced lift pad that is provided with sufficient structural rigidity to withstand tool pressure created during cap removal.

According to the present invention, a cap is provided for mounting on a can. The cap includes a shell formed to include an interior region and a tool-receiving aperture opening into the interior region. A ridge is appended to the shell and positioned to lie in the interior region of the cap. The interior ridge includes a downwardly facing lift pad that is arranged to define an upper boundary of the tool-receiving aperture. The lift pad lies in spaced-apart relation to an annular lip on the can once the shell is mounted on the can so that a cap-removal tool can be inserted into the interior region of the shell through the tool-receiving aperture to engage the annular lip on the can and the lift pad on the interior ridge inside the cap.

In preferred embodiments, the cap includes a round top wall and a cylindrical side wall appended to the top wall. The side wall is formed to include the tool-receiving aperture that is located along a lower edge of the side wall so that it provides access to the annular lip on the can once the cap is mounted on top of the can. The side wall includes an interior surface and the interior ridge is appended to the interior surface at a location just above the tool-receiving aperture. The interior ridge is arranged to project inwardly from the interior surface toward a central vertical axis of the cap extending through the center of the top wall.

The interior ridge includes a mass of material in the interior region of the shell overlying the horizontally extending lift pad located just above the tool-receiving aperture. This material rigidifies the interior ridge and its lift pad to provide sufficient structural rigidity to withstand tool pressure applied to the lift pad during cap removal.

The interior ridge and its lift pad are positioned above the tool-receiving aperture to disallow a person from using a cap-removal tool such as a flat blade screwdriver improperly (e.g., inserting the blade tip at a steep angle upwardly into the interior region of the cap) during cap removal in a way that might inadvertently puncture a dome-shaped closure member provided at the top of the cap and located to be covered by the cap. Essentially, the downwardly facing lift pad on the interior ridge will engage the blade tip of a flat blade screwdriver that is inserted upwardly into the tool-receiving aperture at an angle to the central vertical axis of the cap other than 90°. Provision of the lift pad on the interior ridge thus blocks inward movement of the blade tip toward engagement with the dome-shaped closure member of the can without blocking the type of engagement between the blade tip on the lift pad of the interior ridge and the annular lip of the can needed to allow a person to use the screwdriver to pry the cap off the can.

In a preferred embodiment, the cap further includes a cylindrical interior sleeve depending from an interior surface of the top wall and lying in the interior region of the shell. The interior sleeve includes a flange that grips a top portion of the dome-shaped closure member to hold the cap in a mounted position on the can and position the tool-receiving aperture formed in the side wall adjacent to the annular lip on the can.

In use, the cap is mounted on a "necked-in" can having a body and a dome-shaped closure member coupled to the body at an annular lip. The cap is configured so that the lift pad lies above and in spaced-apart relation to the annular lip on the can when the cap is mounted on the can. A tool such as a flat blade screwdriver can be inserted through the tool-receiving aperture in the side wall so that the blade tip extends into the interior region of the shell and engages the annular lip and the overlying lift pad of the interior ridge. The user then rotates the handle of the screwdriver to turn the flat blade so as to "lift" the lift pad away from the annular lip on the can and "break" a releasable connection between the interior sleeve flange and the top portion of the dome-shaped closure member to facilitate removal of the cap from the can.

Additional objects, features, and advantages of the invention will become apparent to those skilled in the art upon consideration of the following detailed description of preferred embodiments exemplifying the best mode of carrying out the invention as presently perceived.

DESCRIPTION OF THE DRAWINGS

The detailed description particularly refers to the accompanying figures in which.

DETAILED DESCRIPTION OF THE DRAWINGS

Figure 1:
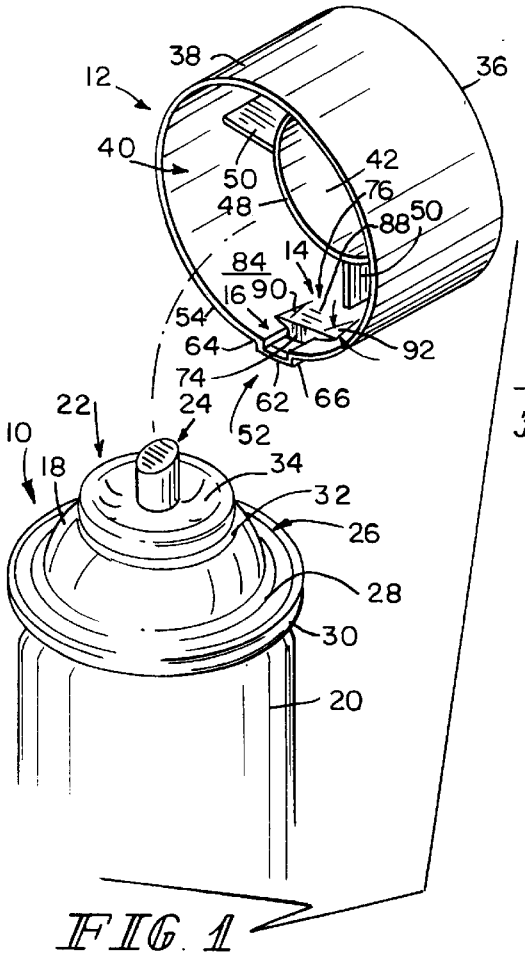
FIG. 1 is a perspective view of a cap in accordance with the present invention prior to installation of the cap on a necked-in can having a cylindrical body, a closure member coupled to a necked-in portion of the cylindrical body at an annular lip, and a spray button mounted on the closure member and showing a cylindrical interior sleeve, two of four interior sleeve support ribs, and a reinforced ridge located in an interior region of the cap, the reinforced ridge being positioned to lie in the interior region of the cap adjacent to a tool-receiving aperture formed in a side wall of the cap and configured to include a lift pad or ridge edge positioned to engage a tool inserted into the tool-receiving aperture during removal of the cap from the can.

The top end of an aerosol spray can 10 and a cap 12 for mounting on the can 10 are shown in FIG. 1. The improved cap 12 is configured to include an interior ridge 14 that can be accessed through a tool-receiving aperture 16 formed in the cap 12 by a person that is using a tool such as a flat blade screwdriver to pry cap 12 off of can 10 in the manner shown in FIGS. 5–7. Interior ridge 14 is sturdy and configured to withstand a load applied by a screwdriver blade during cap removal and is positioned to block the screwdriver blade tip from damaging or puncturing a dome-shaped portion 18 of the can 10 during cap removal.

Can 10 is a well-known conventional necked-in design and includes a cylindrical body 20, a top closure member 22, and a discharge mechanism mounted to a necked-in portion of the closure member 22 and configured to include a push-to-spray button 24. Closure member 22 is a two-piece metal stamping that is assembled and mounted on body 20 to cover a top opening formed in the cylindrical body 20. The first piece is a dome-shaped base 26 formed to include an annular foundation 28, the dome 18 rising up from foundation 28, a rolled annular lip 30 lying around foundation 28 and connecting to an upper annular portion of cylindrical body 20, and an annular top rim 32. The second piece is a round top cover 34 that is coupled to the annular top rim 32 and formed to support a typical push-to-spray button such as button 24.

As shown in FIGS. 1–4, cap 12 includes a round top wall 36 and a cylindrical side wall 38 appended to a perimeter edge of top wall 36. Top and side walls 36, 38 cooperate to define an interior region 40 of cap 12 that is sized to receive the closure member 22 and push-to-spray button 24 of can 10 when cap 12 is mounted on can 10 as shown, for example, in FIG. 6.

Figure 3:
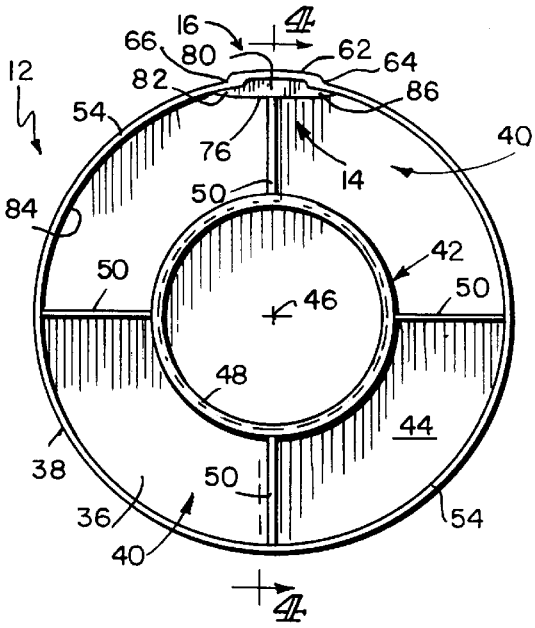
FIG. 3 is a bottom view of the cap of FIG. 1 taken along line 3—3 of FIG. 2 showing the position of the cylindrical interior sleeve and four radially extending sleeve support ribs in the interior region of the cap and showing the position of the lift pad on the reinforced ridge in the interior region of the cap adjacent to one of the sleeve support ribs.
Figure 4:
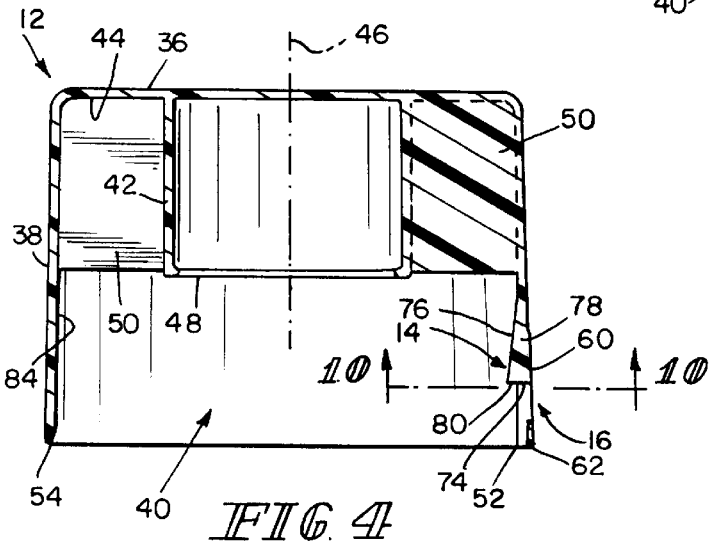
FIG. 4 is a sectional elevation view of the cap of FIG. 1 taken along line 4—4 of FIG. 3 showing an inclined wall of the reinforced ridge appended to an interior surface of the cap and positioned to lie above the lift pad or ridge edge in the interior of the cap.

Cap 12 also includes a mount such as a cylindrical interior sleeve 42 appended to inner surface 44 of top wall 36 and arranged to lie in concentric relation to cylindrical side wall 38 about a central vertical axis 46 of cap 12. An annular grip flange 48 is formed on a lower edge of interior sleeve 42 and configured to releasably grip round top cover 34 of closure member 22 as shown, for example, in FIG. 6 to retain cap 12 in a fixed (but releasable) mounted position on can 10. Four support ribs 50 are provided in interior region 40 to rigidify interior sleeve 42 and the rest of cap 12. Ribs 50 are arranged in circumferentially spaced-apart relation as shown in FIG. 3. Each rib 50 extends radially as shown in FIG. 3 and vertically as shown in FIG. 4 to interconnect side wall 38 and interior sleeve 42. A wide variety of other rib shapes, configurations, and arrangements are suitable for use in cap 12.

Figure 2:
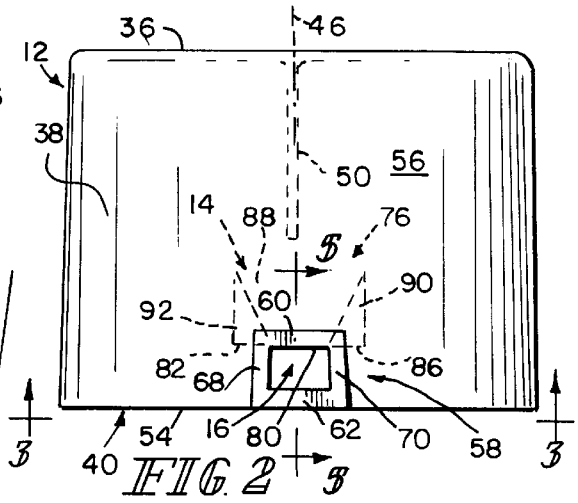
FIG. 2 is a side elevation view of the cap of FIG. 1 showing a rectangular raised border strip around the tool-receiving aperture formed in the side wall of the cap and showing (in phantom) the location of the reinforced ridge and one of the sleeve support ribs that are positioned to lie in the interior region of the cap.
Figure 10:
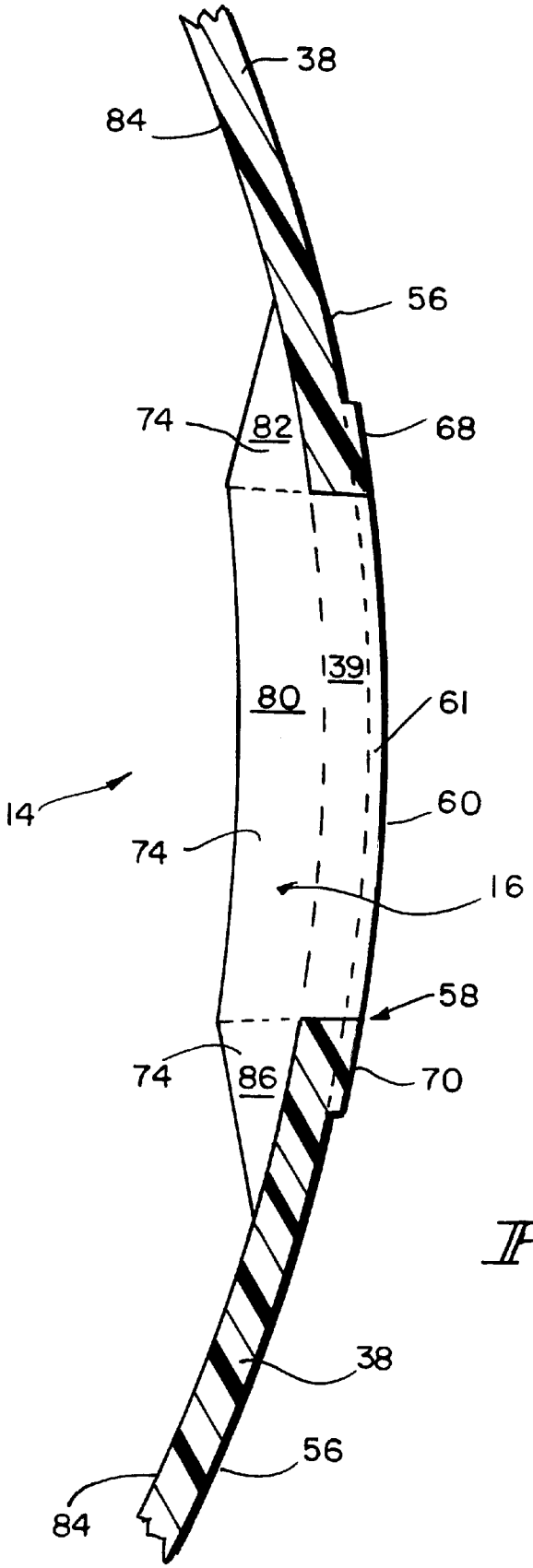
FIG. 10 is an enlarged sectional view taken along line 10—10 of FIG. 4 showing the ridge edge including a curved elongated central surface and triangular wing surfaces on either side of the curved elongated central surface.

Side wall 38 of cap 12 is formed to include a notch 52 along its lower annular perimeter edge 54 for defining tool-receiving aperture 16 as shown, for example, in FIG. 1. A top boundary of tool-receiving aperture 16 is defined by a top boundary edge 39 and an undersurface 61 as shown, for example, in FIGS. 4, 5, and 10. As shown in FIG. 2, side wall 38 includes exterior surface 56 and a rectangular raised border strip 58 appended to exterior surface 56. Border strip 58 includes top segment 60 above tool-receiving aperture 16, bottom segment 62 lying in spaced-apart parallel relation to top segment 60 and extending across notch 52 to interconnect ends 64, 66 of lower annular perimeter edge 54 (as shown best in FIG. 1), and two side segments 68, 70 lying in spaced-apart relation to one another and interconnecting top and bottom segments 60, 62. Essentially, rectangular raised border strip 58 provides a window frame for the tool-receiving aperture 16 formed in cap side wall 38.

Figure 5:
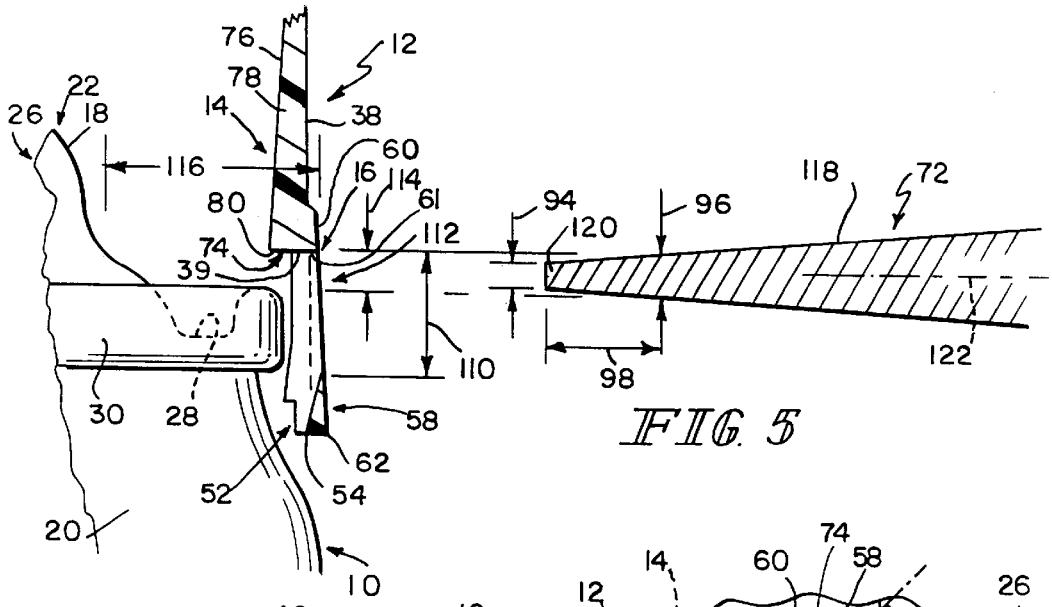
FIG. 5 is an enlarged sectional view of a portion of the cap of FIG. 1 including the interior reinforced ridge once the cap has been installed on the can of FIG. 1 to position the downwardly facing lift pad in spaced-apart relation to the underlying annular lip on the can and prior to insertion of a flat blade screwdriver into the tool-receiving aperture formed in the side wall of the cap in a position adjacent to the lift pad located in the interior region of the cap.

Interior ridge 14 is positioned to lie in interior region 40 of cap 12 just above tool-receiving aperture 16 as shown, for example, in FIGS. 1 and 5. A tool 72 such as a flat blade screwdriver used to pry cap 12 off of can 10 will engage both interior ridge 14 in cap 12 and annular lip 30 on can 10 during cap removal.

Interior ridge 14 includes a horizontally extending, downwardly facing ridge edge or lift pad 74, an inclined wall 76, and rigidifying material 78 lying in the interior region of cap 12. As shown, for example, in FIGS. 1, 3, and 5, lift pad 74 extends into interior region 40 of cap 12 and faces toward lower annular perimeter edge 54 of side wall 38. Lift pad 74 has an elongated central surface 80 that is contiguous with top boundary edge 39 and adjacent to the top boundary of the tool-receiving aperture 16, a first wing surface 82 appended to one side of elongated central surface 80 and to a portion of an interior surface 84 of side wall 38, and a second wing surface 86 appended to another side of elongated central surface 80 on another side of tool-receiving aperture 16. As shown best in FIG. 3, elongated central surface 80 has a somewhat curved shape and each of the first and second wing surfaces 82, 86 have a somewhat triangular shape.

Inclined wall 76 of interior ridge 14 has a lower edge abutting lift pad 74 and an upper edge abutting and merging with interior surface 84 of side wall 38. Inclined wall 76 is oriented to lie at an angle relative to central vertical axis 46 of cap 12. Inclined wall 76 includes a central trapezoidal surface 88, a first triangular surface 90 extending from one side of central trapezoidal surface 88 to interior surface 84 of side wall 38, and a second triangular surface 92 extending from another side of central trapezoidal surface 88 to interior surface 84 of side wall 38 as shown, for example, in FIG. 10.

As shown in FIGS. 1 and 2, interior ridge 14 is appended to interior surface 84 of side wall 38 to lie between tool-receiving aperture 16 and one of the support ribs 50. The interior support rib 50 located adjacent to interior ridge 14 serves to strengthen and rigidify interior ridge 14.

Figure 6:
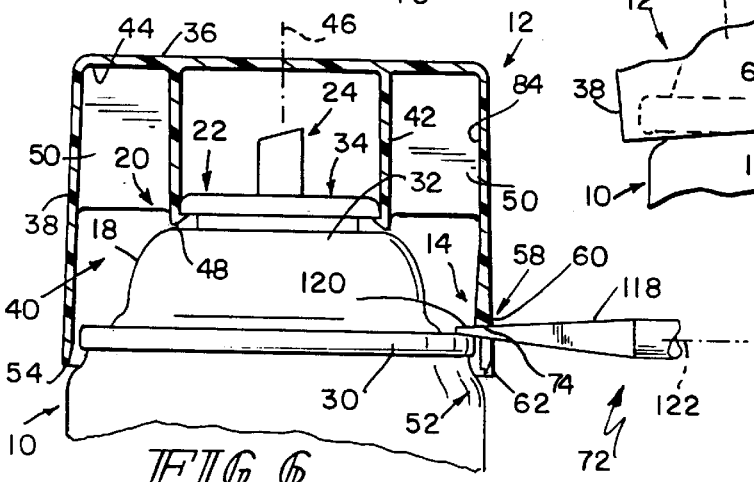
FIG. 6 is a view of the cap and can of FIG. 1 showing engagement of the cylindrical interior sleeve and the closure member to retain the cap on the can and insertion of the flat blade screwdriver of FIG. 5 into the tool-receiving aperture formed in the cap at a "proper" insertion angle so that one side of the screwdriver blade engages the annular lip on the can and the other side of the screwdriver blade engages the lift pad.
Figure 7:
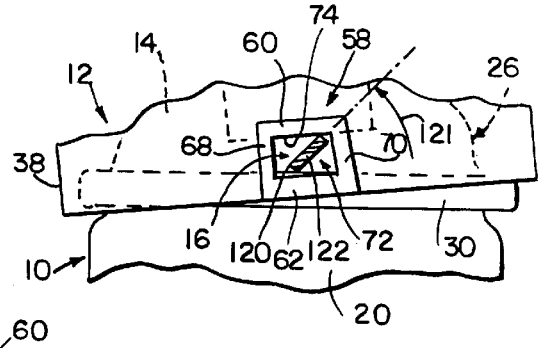
FIG. 7 is a view showing rotation of the screwdriver blade of FIG. 6 about its longitudinal axis to break the connection between the cylindrical interior sleeve and the closure member shown in FIG. 6 to disengage the cap from the can.

Use of a cap-removal tool 72 such as a flat blade screwdriver to remove cap 12 from can 10 is shown in sequence in FIGS. 5–7. Referring to FIG. 5, several dimensions of a presently preferred embodiment are provided. Tool 72 is a quarter inch wide flat blade screwdriver wherein dimension 94 is about 0.045 inch (0.114 cm), dimension 96 is about 0.078 inch (0.198 cm), and dimension 98 is about 0.210 inch (0.533 cm). Tool-receiving aperture 16 has a dimension 110 of about 0.235 inch (0.597 cm). The tool-receiving space 112 formed between lift pad 74 and annular lip 30 when cap 12 is mounted on can 10 has a dimension 114 of about 0.070 inch (0.178 cm). Dimension 116 is about 0.365 inch (0.927 cm).

Screwdriver 72 includes a blade 118 having a tip 120 that is sized to be insertable into the interior region 40 of cap 12 through tool-receiving aperture 16 to initiate removal of cap 12 from can 10. Blade tip 120 is moved from a position outside cap 12 shown in FIG. 5 to a position inside cap 12 shown in FIG. 6. Once inserted, a top surface on blade tip 120 engages lift pad 74 of interior ridge 14 and a bottom surface on blade tip 120 engages the top surface of annular lip 30 of can 10. If cap-removal tool 72 is oriented properly, the top surface on blade tip 120 simultaneously engages ridge edge 74, top boundary edge 39, and undersurface 61. The blade tip 120 can be rotated in direction 121 about tool axis 122 as shown in FIG. 6 to urge lift pad 74 away from the underlying annular lip 30 an amount sufficient to disengage grip flange 48 on interior sleeve 42 from round cover 34 on can 10 during removal of cap 12 from can 10.

Figure 8:
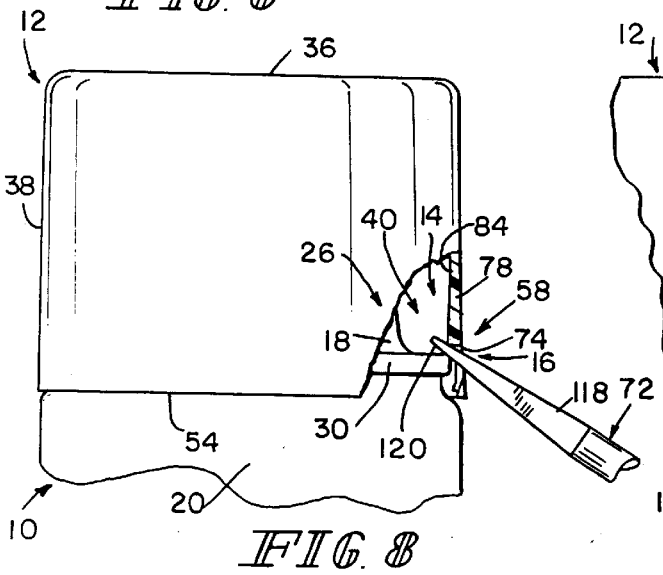
FIG. 8 is a view similar to FIG. 6 showing insertion of the screwdriver blade into the tool-receiving aperture formed in the cap at an "improper" (e.g., steep) angle causing the blade tip to be aimed at the domed portion of the closure member.
Figure 9:
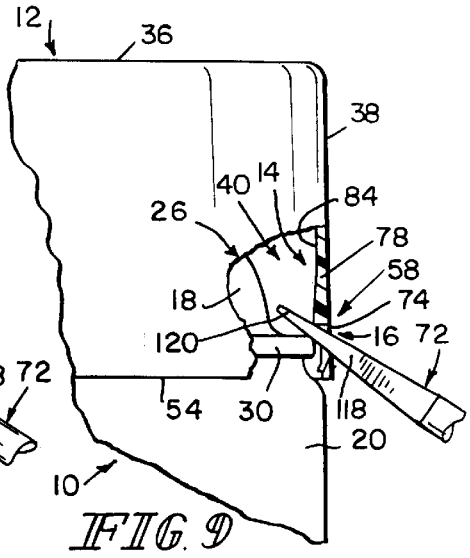
FIG. 9 is a view similar to FIG. 8 showing how the reinforced ridge is configured and positioned in the interior region of the cap to block further movement of the blade tip into the interior region of the cap in a direction toward the domed portion of the closure member to disallow a user from inadvertently engaging the blade tip and the domed portion of the closure member during cap removal.

Operation of interior ridge 14 to block or otherwise limit inward movement of blade tip 120 in interior region 40 of cap 12 in a direction toward the dome 18 of dome-shaped base 26 is shown in FIGS. 8 and 9. Initially, blade tip 120 is able to move through tool-receiving aperture 16 and space 112 to the position shown in FIG. 8. Then, the location and position of lift pad 74, which is reinforced by material 78 included in interior ridge 14, blocks inward movement of blade tip 120 as shown in FIG. 9 by restricting blade clearance so blade tip 120 cannot inadvertently engage and puncture dome 18 during cap removal.

Although the invention has been described in detail with reference to certain preferred embodiments, variations and modifications exist within the scope and spirit of the invention as described and defined in the following claims.

What is claimed is:

1. A cap adapted for mounting on a necked-in can that includes an outer cylindrical wall having a top opening and an upper portion that is recessed radially inwardly toward the top opening, a top closure member having an outer periphery coupled to the upper portion of the outer cylindrical wall to form a chime, a dome portion extending radially inwardly from the outer periphery, and a top discharge portion coupled to the dome portion to form a top annular rim, the cap comprising a shell including a cylindrical side wall and a top wall appended to an upper portion of the side wall, the side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a downwardly facing top boundary edge defining a top boundary of the tool-receiving aperture, the top boundary edge having a radial width and a first arc length, a mount coupled to the shell and positioned to lie in the interior region of the shell, the mount being adapted to engage the top annular rim of the necked-in can to mount the cap on the necked-in can, a lower portion of the side wall being adapted to be positioned to lie around and outside the chime and above a portion of the outer wall of the necked-in can when the cap is mounted on the necked-in can, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge that is substantially coplanar with the top boundary edge, the ridge edge being adapted to be spaced apart from the chime by a distance that allows a cap-removal tool to be inserted into the interior region of the shell through the tool-receiving aperture so that one portion of the cap-removal tool provides a fulcrum resting on the chime, another portion of the cap-removal tool engages the ridge edge, and as the cap-removal tool is rotated about a longitudinal axis extending through the tool-receiving aperture the cap-removal tool acts between the ridge edge and the chime to demount the cap from the necked-in can, the tool-receiving aperture being sized to allow the cap-removal tool to maintain constant contact with the chime and to allow the cap-removal tool constantly to be spaced apart from the dome portion of the necked-in can as the cap-removal tool is rotated during demounting of the cap from the necked-in can, the ridge edge extending chordally relative to the cylindrical interior surface along a second arc length that is longer than the first arc length, the ridge having an uppermost portion that is spaced apart from the top wall of the shell.

2. The cap of claim 1, wherein the shell further includes a border strip appended to the cylindrical side wall and positioned to border the tool-receiving aperture, the border strip includes a top segment having a downwardly facing bottom edge that is substantially coplanar with the top boundary edge, the top segment includes a top edge spaced apart from the bottom edge by a first distance, and the perimeter includes a top perimeter portion that is spaced apart from the ridge edge by a second distance that is larger than the first distance.

3. The cap of claim 1, wherein the shell further includes a rib extending radially between the cylindrical side wall and the mount, the rib including a bottom edge, and the uppermost portion of the ridge is positioned to lie between the bottom edge of rib and the tool-receiving aperture.

4. The cap of claim 1, wherein the shell further includes a border strip appended to the cylindrical side wall, the border strip includes a bottom segment having an upwardly facing edge defining a bottom boundary of the tool-receiving aperture, and the border strip remains intact during demounting of the cap from the necked-in can.

5. The cap of claim 1, wherein the mount is adapted to cause the top boundary edge to lie about 0.070 inch (0.178 cm) above the chime and to cause the ridge edge to lie about 0.070 inch (0.178 cm) vertically above the chime when the cap is mounted on the necked-in can.

6. A cap adapted for mounting on a necked-in can that includes an outer cylindrical wall having a top opening and an upper portion that is recessed radially inwardly toward the top opening, a top closure member having an outer periphery coupled to the upper portion of the outer cylindrical wall to form a chime, a dome portion extending radially inwardly from the outer periphery, and a top discharge portion coupled to the dome portion to form a top annular rim, the cap comprising a shell including a cylindrical side wall and a top wall appended to an upper portion of the side wall, the side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a downwardly facing top boundary edge defining a top boundary of the tool-receiving aperture, the top boundary edge having a radial width and a first arc length, a mount coupled to the shell and positioned to lie in the interior region of the shell, the mount being adapted to engage the top annular rim of the necked-in can to mount the cap on the necked-in can, a lower portion of the side wall being adapted to be positioned to lie around and outside the chime and above a portion of the outer wall of the necked-in can when the cap is mounted on the necked-in can, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge that is substantially coplanar with the top boundary edge, the ridge edge being adapted to be spaced apart from the chime by a distance that allows a cap-removal tool to be inserted into the interior region of the shell through the tool-receiving aperture so that one portion of the cap-removal tool provides a fulcrum resting on the chime, another portion of the cap-removal tool engages the ridge edge, and as the cap-removal tool is rotated about a longitudinal axis extending through the tool-receiving aperture the cap-removal tool acts between the ridge edge and the chime to demount the cap from the necked-in can, the tool-receiving aperture being sized to allow the cap-removal tool to maintain constant contact with the chime and to allow the cap-removal tool constantly to be spaced apart from the dome portion of the necked-in can as the cap-removal tool is rotated during demounting of the cap from the necked-in can, the ridge edge extending chordally relative to the cylindrical interior surface along a second arc length that is longer than the first arc length, the ridge merging with the side wall of the shell along a perimeter that is spaced apart from the top wall of the shell.

7. The cap of claim 6, wherein the ridge merges with the cylindrical side wall of the shell about the perimeter at an acute included angle.

8. A cap adapted for mounting on a necked-in can that includes an outer cylindrical wall having a top opening and an upper portion that is recessed radially inwardly toward the top opening, a top closure member having an outer periphery coupled to the upper portion of the outer cylindrical wall to form a chime, a dome portion extending radially inwardly from the outer periphery, and a top discharge portion coupled to the dome portion to form a top annular rim, the cap comprising a shell including a cylindrical side wall and a top wall appended to an upper portion of the side wall, the side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a downwardly facing top boundary edge defining a top boundary of the tool-receiving aperture and a pair of substantially vertical side edges defining opposite side boundaries of the tool-receiving aperture, the top boundary edge extending a first arc length between the side edges, a mount coupled to the shell and positioned to lie in the interior region of the shell, the mount being adapted to engage the top annular rim of the necked-in can to mount the cap on the necked-in can, a lower portion of the side wall being adapted to be positioned to lie around and outside the chime and above a portion of the outer wall of the necked-in can when the cap is mounted on the necked-in can, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge that is substantially coplanar with the top boundary edge, the ridge edge being adapted to be spaced apart from the chime by a distance that allows a cap-removal tool to be inserted into the interior region of the shell through the tool-receiving aperture so that one portion of the cap-removal tool provides a fulcrum resting on the chime, another portion of the cap-removal tool engages the ridge edge, and as the cap-removal tool is rotated about a longitudinal axis extending through the tool-receiving aperture the cap-removal tool acts between the ridge edge and the chime to demount the cap from the necked-in can, the tool-receiving aperture being sized to allow the cap-removal tool to maintain constant contact with the chime and to allow the cap-removal tool constantly to be spaced apart from the dome portion of the necked-in can as the cap-removal tool is rotated during demounting of the cap from the necked-in can, the ridge merging with the side wall of the shell along a perimeter including a top perimeter portion that is spaced apart from the top wall of the shell and having a pair of side perimeter portions extending upwardly from the ridge edge, the side perimeter portions including respective lower subportions that are spaced apart by a second arc length that is longer than the first arc length, the ridge edge extending chordally between the lower subportions of the perimeter of the ridge.

9. The cap of claim 8, wherein the side perimeter portions are inclined with respect to the vertical side edges of the aperture.

10. The cap of claim 8, wherein the shell further includes a rib extending radially between the cylindrical side wall and the mount, the rib including a bottom edge, and the perimeter of the ridge is positioned to lie between the bottom edge of rib and the tool-receiving aperture.

11. The cap of claim 8, wherein the mount is adapted to cause the top boundary edge to lie about 0.070 inch (0.178 cm) above the chime and to cause the chordally extending ridge edge to lie about 0.070 inch (0.178 cm) vertically above the chime when the cap is mounted on the necked-in can.

12. A cap adapted for mounting on a necked-in can that includes an outer cylindrical wall having a top opening and an upper portion that is recessed radially inwardly toward the top opening, a top closure member having an outer periphery coupled to the upper portion of the outer cylindrical wall to form a chime, a dome portion extending radially inwardly from the outer periphery, and a top discharge portion coupled to the dome portion to form a top annular rim, the cap comprising a shell including a cylindrical side wall and a top wall appended to an upper portion of the side wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a downwardly facing top boundary edge defining a top boundary of the tool-receiving aperture and a pair of substantially vertical side edges defining opposite side boundaries of the tool-receiving aperture, the top boundary edge extending a first arc length between the side edges, a mount coupled to the shell and positioned to lie in the interior region of the shell, the mount being adapted to engage the top annular rim of the necked-in can to mount the cap on the necked-in can, a lower portion of the side wall being adapted to be positioned to lie around and outside the chime and above a portion of the outer wall of the necked-in can when the cap is mounted on the necked-in can, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge that is substantially coplanar with the top boundary edge, the ridge edge being adapted to be spaced apart from the chime by a distance that allows a cap-removal tool to be inserted into the interior region of the shell through the tool-receiving aperture so that one portion of the cap-removal tool provides a fulcrum resting on the chime, another portion of the cap-removal tool engages the ridge edge, and as the cap-removal tool is rotated about a longitudinal axis extending through the tool-receiving aperture the cap-removal tool acts between the ridge edge and the chime to demount the cap from the necked-in can, the tool-receiving aperture being sized to allow the cap-removal tool to maintain constant contact with the chime and to allow the cap-removal tool constantly to be spaced apart from the dome portion of the necked-in can as the cap-removal tool is rotated during demounting of the cap from the necked-in can, the ridge merging with the side wall of the shell along a perimeter including a top perimeter portion that is spaced apart from the top wall of the shell and having a pair of side perimeter portions extending upwardly from the ridge edge, the side perimeter portions including respective lower subportions that are spaced apart by a second arc length that is longer than the first arc length, the ridge edge extending chordally between the lower subportions of the perimeter of the ridge, the side perimeter portions including respective upper portions spaced apart by a third arc length being smaller than the second arc length.

13. A cap in combination with a necked-in can, the necked-in can comprising an outer wall, an upper portion of the outer wall curving inwardly to terminate at a recessed annular lip, a domed portion having a lower edge and an upper edge, and a top discharge portion, the annular lip connecting the inwardly curving upper portion of the outer wall to the lower edge of the domed portion, the upper edge of the domed portion being connected to the top discharge portion at a top annular rim, the cap comprising a shell including a side wall and a top wall appended to an upper portion of the side wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface lying in the interior region of the shell, a mount coupled to the shell and positioned to lie in the interior region of the shell, the mount engaging the top annular rim of the necked-in can to mount the cap on the necked-in can, a lower portion of the side wall being positioned to lie around and outside the recessed annular lip of the necked-in can and above the inwardly curving upper portion of the outer wall when the cap is mounted on the necked-in can, and a ridge appended to the interior surface of the side wall and positioned to lie in the interior region of the shell, the ridge cooperating with the side wall to provide the cap with a thickened portion adjacent to the tool-receiving aperture, the ridge including a ridge edge extending chordally relative to the cylindrical interior surface, the ridge edge being spaced apart from the recessed annular lip by a distance that allows a cap-removal tool to be inserted into the interior region of the shell through the tool-receiving aperture so that one portion of the cap-removal tool provides a fulcrum resting on the recessed annular lip, another portion of the cap-removal tool engages the ridge edge, and as the cap-removal tool is rotated about a longitudinal axis extending through the tool-receiving aperture the cap-removal tool acts between the ridge edge and the recessed annular lip to demount the cap from the necked-in can, the tool-receiving aperture being sized to allow the cap-removal tool to maintain constant contact with the recessed annular lip and to allow the cap-removal tool constantly to be spaced apart from the dome portion of the necked-in can as the cap-removal tool is rotated during demounting of the cap from the necked-in can.

14. The combination of claim 13, wherein the top wall of the shell lies in a first plane, the chordally extending ridge edge of the ridge lies in a second plane aligned in spaced-apart parallel relation to the first plane, and the ridge further includes an inclined wall extending in the interior region of the shell from the side wall in a direction toward the ridge edge and lying at an angle relative to the ridge edge to define an acute included angle therebetween.

15. The combination of claim 13, wherein the chordally extending ridge edge includes a downwardly facing elongated central surface contiguous with the top boundary edge of the side wall, a downwardly facing first wing surface contiguous with one side of the elongated central surface and extending chordally beyond the top boundary edge to a portion of the interior surface of the side wall on one side of the tool-receiving aperture, and a downwardly facing second wing surface contiguous with another side of the elongated central surface and extending chordally beyond the top boundary edge to another portion of the interior surface on another side of the tool-receiving aperture.

16. The combination of claim 13, wherein the side wall includes an exterior surface and a raised border strip appended to the exterior surface and bordering the tool-receiving aperture, the raised border strip includes a bottom segment having an upwardly facing edge defining a bottom boundary of the tool-receiving aperture, and the bottom segment remaining intact during demounting of the cap from the necked-in can.

17. The combination of claim 13, wherein the mount includes an interior sleeve appended to the shell and positioned to lie in the interior region of the shell and a vertical rib lying in the interior region of the shell and interconnecting the interior sleeve and the interior surface of the shell and wherein the ridge is positioned on the interior surface to lie between the tool-receiving aperture formed in the shell and the vertical rib.

18. The combination of claim 13, wherein the side wall includes an exterior surface and a raised border strip appended to the exterior surface and bordering the tool-receiving aperture, the raised border strip includes a top segment adjacent to a top of the tool-receiving aperture, the raised border strip includes a pair of spaced side segments adjacent to respective sides of the tool-receiving aperture, and the raised border strip includes a bottom segment having an upwardly facing edge that defines a bottom of the tool-receiving aperture.

19. The combination of claim 13, wherein the annular lip includes a top surface, the chordally extending ridge edge is spaced apart from the top surface of the annular lip by a first distance when the cap is mounted on the can, the shell further includes a border strip having a bottom segment appended to the lower end of the side wall portion adjacent to and extending across the tool-receiving aperture, the bottom segment includes an upwardly facing top edge spaced apart from the top surface of the annular lip by a second distance when the cap is mounted on the can, and the second distance is larger than the first distance.

20. The combination of claim 13, wherein the side wall includes a first side boundary edge defining a first side boundary of the tool-receiving aperture and a second side boundary edge defining a second side boundary of the tool-receiving aperture, the first side boundary edge is spaced apart from the second side boundary edge to define an aperture width therebetween, and the ridge edge extends across the aperture width beyond the first side boundary edge and beyond the second side boundary edge.

21. The combination of claim 13, wherein a portion of the ridge edge is positioned to lie above the recessed annular lip.

22. The combination of claim 13, wherein the ridge edge faces the recessed annular lip.

23. The combination of claim 13, wherein the ridge edge is substantially coplanar with the top boundary edge.

24. A cap in combination with a necked-in can, the necked-in can comprising an outer wall, an upper portion of the outer wall curving inwardly to terminate at a recessed annular lip, a domed portion having a lower edge and an upper edge, and a top discharge portion, the annular lip connecting the inwardly curving upper portion of the outer wall to the lower edge of the domed portion, the upper edge of the domed portion being connected to the top discharge portion at a top annular rim, the cap comprising a shell including a side wall and a top wall appended to an upper portion of the side wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface lying in the interior region of the shell, a mount coupled to the shell and positioned to lie in the interior region of the shell, the mount engaging the top annular rim of the necked-in can to mount the cap on the necked-in can, a lower portion of the side wall being positioned to lie around and outside the recessed annular lip of the necked-in can and above the inwardly curving upper portion of the outer wall when the cap is mounted on the necked-in can, and a ridge appended to the interior surface of the side wall and positioned to lie in the interior region of the shell, the ridge cooperating with the side wall to provide the cap with a thickened portion adjacent to the tool-receiving aperture, the ridge including a ridge edge extending chordally relative to the cylindrical interior surface, the ridge edge being spaced apart from the recessed annular lip by a distance that allows a cap-removal tool to be inserted into the interior region of the shell through the tool-receiving aperture so that one portion of the cap-removal tool provides a fulcrum resting on the recessed annular lip, another portion of the cap-removal tool engages the ridge edge, and as the cap-removal tool is rotated about a longitudinal axis extending through the tool-receiving aperture the cap-removal tool acts between the ridge edge and the recessed annular lip to demount the cap from the necked-in can, the tool-receiving aperture being sized to allow the cap-removal tool to maintain constant contact with the recessed annular lip and to allow the cap-removal tool constantly to be spaced apart from the dome portion of the necked-in can as the cap-removal tool is rotated during demounting of the cap from the necked-in can, the side wall including an exterior surface and a raised border strip appended to the exterior surface and bordering the tool-receiving aperture, the raised border strip including a bottom segment having an upwardly facing edge defining a bottom boundary of the tool-receiving aperture, and the bottom segment remaining intact during demounting of the cap from the necked-in can, the exterior surface being formed to include a curved bottom perimeter edge and a notch interrupting the curved perimeter edge and the bottom segment extending across the notch to interconnect one end of the curved perimeter edge on one side of the notch to another end of the curved perimeter edge on an opposite side of the notch.

25. A cap in combination with a necked-in can, the necked-in can comprising an outer wall, an upper portion of the outer wall curving inwardly to terminate at a recessed annular lip, a domed portion having a lower edge and an upper edge, and a top discharge portion, the annular lip connecting the inwardly curving upper portion of the outer wall to the lower edge of the domed portion, the upper edge of the domed portion being connected to the top discharge portion at a top annular rim, the cap comprising a shell including a side wall and a top wall appended to an upper portion of the side wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface living in the interior region of the shell, a mount coupled to the shell and positioned to lie in the interior region of the shell, the mount engaging the top annular rim of the necked-in can to mount the cap on the necked-in can, a lower portion of the side wall being positioned to lie around and outside the recessed annular lip of the necked-in can and above the inwardly curving upper portion of the outer wall when the cap is mounted on the necked-in can, and a ridge appended to the interior surface of the side wall and positioned to lie in the interior region of the shell, the ridge cooperating with the side wall to provide the cap with a thickened portion adjacent to the tool-receiving aperture, the ridge including a ridge edge extending chordally relative to the cylindrical interior surface, the ridge edge being spaced apart from the recessed annular lip by a distance that allows a cap-removal tool to be inserted into the interior region of the shell through the tool-receiving aperture so that one portion of the cap-removal tool provides a fulcrum resting on the recessed annular lip, another portion of the cap-removal tool engages the ridge edge, and as the cap-removal tool is rotated about a longitudinal axis extending through the tool-receiving aperture the cap-removal tool acts between the ridge edge and the recessed annular lip to demount the cap from the necked-in can, the tool-receiving aperture being sized to allow the cap-removal tool to maintain constant contact with the recessed annular lip and to allow the cap-removal tool constantly to be spaced apart from the dome portion of the necked-in can as the cap-removal tool is rotated during demounting of the cap from the necked-in can, the annular lip including an outer circumferential perimeter, the ridge edge including a first portion positioned to lie above and radially inward of the outer circumferential perimeter, and the ridge edge including a second portion positioned to lie above and radially outward of the outer circumferential perimeter.

26. A cap in combination with a necked-in can, the necked-in can comprising an outer wall, an upper portion of the outer wall curving inwardly to terminate at a recessed annular lip, a domed portion having a lower edge and an upper edge, and a top discharge portion, the annular lip connecting the inwardly curving upper portion of the outer wall to the lower edge of the domed portion, the upper edge of the domed portion being connected to the top discharge portion at a top annular rim, the cap comprising a shell including a side wall and a top wall appended to an upper portion of the side wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface lying in the interior region of the shell, a mount coupled to the shell and positioned to lie in the interior region of the shell, the mount engaging the top annular rim of the necked-in can to mount the cap on the necked-in can, a lower portion of the side wall being positioned to lie around and outside the recessed annular lip of the necked-in can and above the inwardly curving upper portion of the outer wall when the cap is mounted on the necked-in can, and a ridge appended to the interior surface of the side wall and positioned to lie in the interior region of the shell, the ridge cooperating with the side wall to provide the cap with a thickened portion adjacent to the tool-receiving aperture, the ridge including a ridge edge extending chordally relative to the cylindrical interior surface, the ridge edge being spaced apart from the recessed annular lip by a distance that allows a cap-removal tool to be inserted into the interior region of the shell through the tool-receiving aperture so that one portion of the cap-removal tool provides a fulcrum resting on the recessed annular lip, another portion of the cap-removal tool engages the ridge edge, and as the cap-removal tool is rotated about a longitudinal axis extending through the tool-receiving aperture the cap-removal tool acts between the ridge edge and the recessed annular lip to demount the cap from the necked-in can, the tool-receiving aperture being sized to allow the cap-removal tool to maintain constant contact with the recessed annular lip and to allow the cap-removal tool constantly to be spaced apart from the dome portion of the necked-in can as the cap-removal tool is rotated during demounting of the cap from the necked-in can, the ridge edge including an elongated central surface including a radially inner perimeter having a concave curved shape.

27. A cap in combination with a necked-in can for use with a flat-blade screwdriver having a blade having a first thickness at a first location and a second thickness greater than the first thickness at a second location, the second location being spaced apart from the first location, the necked-in can comprising a body including a container wall and a reduced-diameter neck appended to an upper end of the container wall and formed to extend radially inwardly from the container wall toward a central vertical axis of the body and include a top opening, and a top closure member including a dome covering the top opening and a radially outermost annular lip appended to the dome and connecting the dome to a top portion of the reduced-diameter neck and lying around the top opening in the reduced-diameter neck, and the cap comprising a shell having a central vertical axis extending therethrough and being formed to include an interior region, the shell including a cylindrical side wall defining a boundary of the interior region, the side wall being configured to lie in spaced-apart relation to the dome when the cap is mounted on the necked-in can, a lower portion of the side wall being positioned to lie around and outside the radially outermost annular lip and above a portion of the reduced-diameter neck when the cap is mounted on the necked-in can, the shell including an edge defining a tool-receiving aperture in the shell, and a tool-blocker ridge appended to the shell and extending chordally relative to the cylindrical side wall in the interior region of the shell adjacent to the edge and vertically above at least a portion of the radially outermost annular lip of the top closure member of the necked-in can to engage and limit insertion of the blade of the flat-blade screwdriver into the interior region of the shell through the tool-receiving aperture when the cap is mounted on the necked-in can, the tool-blocker ridge being spaced apart from the radially outermost annular lip by a distance that results in the blade becoming wedged between the tool-blocker ridge and the radially outermost annular rim so that the blade is prevented from contacting the dome during insertion of the blade into the interior region of the shell through the tool-receiving aperture, the tool-blocker ridge being spaced apart from the radially outermost annular lip by a distance that allows one portion of the blade to rest on the radially outermost annular lip of the necked-in can and that allows another portion of the blade to engage the tool-blocker ridge, and as the blade is rotated about a longitudinal axis extending through the tool-receiving aperture the blade acts between the tool-blocker ridge and the radially outermost annular lip to demount the cap from the necked-in can, the tool-receiving aperture having appropriate size to allow the blade to maintain constant contact with the radially outermost annular lip of the necked-in can and to allow the blade to be constantly spaced apart from the dome of the necked-in can as the blade is rotated during demounting of the cap from the necked-in can.

28. The combination of claim 27, wherein the lower portion of the side wall includes a lower edge defining a can-receiving opening and the tool-blocker ridge includes a horizontally and chordally extending ridge edge projecting into the interior region of the shell and facing toward the lower edge of the cap.

29. The combination of claim 27, wherein the shell includes an interior surface and the tool-blocker ridge includes an inclined wall positioned to lie in the interior region of the shell at an angle to the central vertical axis of the shell and formed to include a lower end abutting the ridge edge and an upper end abutting the interior surface of the shell and reinforcement material located in the interior region of the shell between the inclined wall and the interior surface and above the ridge edge to strengthen and rigidify the ridge edge.

30. The combination of claim 27, wherein the mount is configured to cause the top boundary edge to lie about 0.070 inch (0.178 cm) above the radially outermost annular lip of the top closure member and to cause the chordally extending ridge edge to lie about 0.070 inch (0.178 cm) vertically above the radially outermost annular lip of the top closure member when the cap is mounted on the necked-in can.

31. A cap in combination with a necked-in can, the necked-in can comprising an outer wall, an upper portion of the outer wall curving inwardly to terminate at a chime, a domed portion having a lower edge and an upper edge, and a top discharge portion, the chime connecting the inwardly curving upper portion of the outer wall to the lower edge of the domed portion, the upper edge of the domed portion being connected to the top discharge portion at a top annular rim, the cap comprising a shell including a side wall and a top wall appended to an upper portion of the side wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface lying in the interior region of the shell, a mount coupled to the shell and positioned to lie in the interior region of the shell, the mount engaging the top annular rim of the necked-in can to mount the cap on the necked-in can, a lower portion of the side wall being positioned to lie around and outside the chime of the necked-in can and above the inwardly curving upper portion of the outer wall when the cap is mounted on the necked-in can, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge that is substantially coplanar with the top boundary edge, the ridge edge being adapted to be spaced apart from the chime by a distance that allows a cap-removal tool to be inserted into the interior region of the shell through the tool-receiving aperture so that one portion of the cap-removal tool provides a fulcrum resting on the chime, another portion of the cap-removal tool engages the ridge edge, and as the cap-removal tool is rotated about a longitudinal axis extending through the tool-receiving aperture the cap-removal tool acts between the ridge edge and the chime to demount the cap from the necked-in can, the tool-receiving aperture being sized to allow the cap-removal tool to maintain constant contact with the chime and to allow the cap-removal tool constantly to be spaced apart from the dome portion of the necked-in can as the cap-removal tool is rotated during demounting of the cap from the necked-in can, the ridge edge extending chordally relative to the cylindrical interior surface along a second arc length that is longer than the first arc length.

32. A cap in combination with a necked-in can, the necked-in can comprising an outer wall, an upper portion of the outer wall curving inwardly to terminate at a chime, a domed portion having a lower edge and an upper edge, and a top discharge portion, the chime connecting the inwardly curving upper portion of the outer wall to the lower edge of the domed portion, the upper edge of the domed portion being connected to the top discharge portion at a top annular rim, the cap comprising a shell including a side wall and a top wall appended to an upper portion of the side wall, the side wall extending downwardly from a perimeter of the top wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface lying in the interior region of the shell, a mount coupled to the shell and positioned to lie in the interior region of the shell, the mount engaging the top annular rim of the necked-in can to mount the cap on the necked-in can, a lower portion of the side wall being positioned to lie around and outside the chime of the necked-in can and above the inwardly curving upper portion of the outer wall when the cap is mounted on the necked-in can, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge that is substantially coplanar with the top boundary edge, the ridge edge being adapted to be spaced apart from the chime by a distance that allows a cap-removal tool to be inserted into the interior region of the shell through the tool-receiving aperture so that one portion of the cap-removal tool provides a fulcrum resting on the chime, another portion of the cap-removal tool engages the ridge edge, and as the cap-removal tool is rotated about a longitudinal axis extending through the tool-receiving aperture the cap-removal tool acts between the ridge edge and the chime to demount the cap from the necked-in can, the tool-receiving aperture being sized to allow the cap-removal tool to maintain constant contact with the chime and to allow the cap-removal tool constantly to be spaced apart from the dome portion of the necked-in can as the cap-removal tool is rotated during demounting of the cap from the necked-in can, the ridge merging with the side wall of the shell along a perimeter including a top perimeter portion that is spaced apart from the top wall of the shell and having a pair of side perimeter portions extending upwardly from the ridge edge, the side perimeter portions including respective lower subportions that are spaced apart by a second arc length that is longer than the first arc length, the ridge edge extending chordally between the lower subportions of the perimeter of the ridge.

33. A cap adapted for mounting on a can that includes an outer cylindrical wall having a top opening, a top closure member having an outer periphery coupled to the outer cylindrical wall to form a chime, a dome portion extending radially inwardly from the outer periphery, and a top discharge portion coupled to the dome portion to form a top annular rim, the cap comprising a shell including a top wall and a cylindrical side extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a top boundary edge defining a top boundary of the tool-receiving aperture, and a ridge appended to the interior surface of the side wall and positioned to lie in the interior region of the shell, the ridge cooperating with the side wall to provide the cap with a thickened portion adjacent to and above the tool-receiving aperture, the ridge including a ridge edge, the ridge edge being adapted to be spaced apart from the chime by a distance that allows a cap-removal tool to be inserted into the interior region of the shell through the tool-receiving aperture, the ridge merging with the side wall of the shell along a perimeter that is spaced apart from the top wall of the shell.

34. A cap adapted for mounting on a can that includes an outer cylindrical wall having a top opening, a top closure member having an outer periphery coupled to the outer cylindrical wall to form a chime, a dome portion extending radially inwardly from the outer periphery, and a top discharge portion coupled to the dome portion to form a top annular rim, the cap comprising a shell including a top wall and a cylindrical side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a top boundary edge defining a top boundary of the tool-receiving aperture, and a ridge appended to the interior surface of the side wall and positioned to lie in the interior region of the shell, the ridge cooperating with the side wall to provide the cap with a thickened portion adjacent to and above the tool-receiving aperture, the ridge including a ridge edge, the ridge edge being adapted to be spaced apart from the chime by a distance that allows a cap-removal tool to be inserted into the interior region of the shell through the tool-receiving aperture, the shell further including a rib extending radially to the cylindrical side wall, the rib including a bottom edge, and the perimeter of the ridge is positioned to lie between the bottom edge of rib and the tool-receiving aperture.

35. A cap adapted for mounting on a can that includes an outer cylindrical wall having a top opening, a top closure member having an outer periphery coupled to the outer cylindrical wall to form a chime, a dome portion extending radially inwardly from the outer periphery, and a top discharge portion coupled to the dome portion to form a top annular rim, the cap comprising a shell including a top wall and a cylindrical side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a top boundary edge defining a top boundary of the tool-receiving aperture, and a ridge appended to the interior surface of the side wall and positioned to lie in the interior region of the shell, the ridge cooperating with the side wall to provide the cap with a thickened portion adjacent to and above the tool-receiving aperture, the ridge including a ridge edge and an uppermost portion positioned between the ridge edge and the top wall, the ridge edge being adapted to be spaced apart from the chime by a distance that allows a cap-removal tool to be inserted into the interior region of the shell through the tool-receiving aperture, the ridge having a thickness decreasing from the ridge edge to the uppermost portion so that the ridge merges with the cylindrical side wall along the axial height of the side wall.

36. A cap adapted for mounting on a can that includes an outer cylindrical wall having a top opening, a top closure member having an outer periphery coupled to the outer cylindrical wall to form a chime, a dome portion extending radially inwardly from the outer periphery, and a top discharge portion coupled to the dome portion to form a top annular rim, the cap comprising a shell including a cylindrical side wall and a top wall appended to an upper portion of the side wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a downwardly facing top boundary edge defining a top boundary of the tool-receiving aperture and a pair of substantially vertical side edges defining opposite side boundaries of the tool-receiving aperture, the top boundary edge extending a first arc length between the side edges, and a ridge appended to the interior surface of the side wall and positioned to lie in the interior region of the shell, the ridge cooperating with the side wall to provide the cap with a thickened portion adjacent to and above the tool-receiving aperture, the ridge including a downwardly facing ridge edge, the ridge edge being adapted to be spaced apart from the chime by a distance that allows a cap-removal tool to be inserted into the interior region of the shell through the tool-receiving aperture, the ridge having a pair of side perimeter portions extending upwardly from the ridge edge, the side perimeter portions including respective lower subportions that are spaced apart by a second arc length that is longer than the first arc length, the side perimeter portions including respective upper portions spaced apart by a third arc length being smaller than the second arc length.

37. A cap adapted for mounting on a can that includes an outer cylindrical wall having a top opening, a top closure member having an outer periphery coupled to the outer cylindrical wall to form a chime, a dome portion extending radially inwardly from the outer periphery, and a top discharge portion coupled to the dome portion to form a top annular rim, the cap comprising a shell including a top wall and a cylindrical side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a top boundary edge defining a top boundary of the tool-receiving aperture, the side wall including an exterior surface and a bottom segment having an upwardly facing edge defining a bottom boundary of the tool-receiving aperture, the bottom segment remaining intact during demounting of the cap from the can, the exterior surface being formed to include a curved bottom perimeter edge and a notch interrupting the curved bottom perimeter edge, the bottom segment extending across the notch to interconnect one end of the curved perimeter edge on one side of the notch to another end of the curved perimeter edge on an opposite side of the notch.

38. A cap adapted for mounting on a can that includes an outer cylindrical wall having a top opening, a top closure member having an outer periphery coupled to the outer cylindrical wall to form a chime, a dome portion extending radially inwardly from the outer periphery, and a top discharge portion coupled to the dome portion to form a top annular rim, the cap comprising a shell including a top wall and a cylindrical side wall extending downwardly from a perimeter of the top wall, the side wall and top wall cooperating to define an interior region of the shell, the side wall having a cylindrical interior surface lying in the interior region of the shell, the side wall being formed to include a tool-receiving aperture opening into the interior region of the shell, the side wall including a top boundary edge defining a top boundary of the tool-receiving aperture, and a ridge appended to the interior surface of the side wall and positioned to lie in the interior region of the shell, the ridge cooperating with the side wall to provide the cap with a thickened portion adjacent to the tool-receiving aperture, the ridge including a ridge edge spaced apart from the recessed annular lip by a distance that allows a cap-removal tool to be inserted into the interior region of the shell through the tool-receiving aperture, the ridge edge including a central surface including a radially inner perimeter having a concave curved shape.

39. A cap in combination with a can, the can comprising an outer wall an upper portion terminating at an annular lip, a domed portion having a lower edge and an upper edge, and a top discharge portion, the annular lip connecting the outer wall to the lower edge of the domed portion, the upper edge of the domed portion being connected to the top discharge portion at a top annular rim, the cap comprising a shell including a side wall and a top wall appended to an upper portion of the side wall, the side wall and the top wall cooperating to define an interior region of the shell, the side wall being formed to include a tool-receiving aperture opening into the interior region of the shell, the side wall including a top boundary edge defining a top boundary of the tool-receiving aperture, the side wall having a cylindrical interior surface lying in the interior region of the shell and a ridge appended to the interior surface of the side wall and positioned to lie in the interior region of the shell, the ridge cooperating with the side wall to provide the cap with a thickened portion adjacent to the tool-receiving aperture, the ridge including a ridge edge spaced apart from the recessed annular lip by a distance that allows a cap-removal tool to be inserted into the interior region of the shell through the tool-receiving aperture to demount the cap from the can, the annular lip including an outer circumferential perimeter, the ridge edge including a first portion positioned to lie above and radially inward of the outer circumferential perimeter, and the ridge edge including a second portion positioned to lie above and radially outward of the outer circumferential perimeter, the ridge merging with the side wall of the shell.

* * * * *

Disclaimer 6,112,933 — Erin M. Meyer; David J. Jochem, both of Evansville, Ind. TAMPER-RESISTANT CAP FOR A CONTAINER. Patent dated September 5, 2000. disclaimer filed July 30, 2002, by the assignee, Barry Plastics Corporation.

Hereby enters this disclaimer to claim 37 of said patent.

*(Official Gazette, April 22, 2003)*